United States Patent [19]

Shumaker

[11] 4,309,142

[45] Jan. 5, 1982

[54] SEE-THROUGH BUCKET

[75] Inventor: John F. Shumaker, Mt. Pleasant, Iowa

[73] Assignee: J. I. Case Company, Racine, Wis.

[21] Appl. No.: 140,808

[22] Filed: Apr. 16, 1980

[51] Int. Cl.[3] ..... E02F 3/81

[52] U.S. Cl. ..... 414/722; 37/118 A; 296/200; 172/430; 172/701.1; 350/307

[58] Field of Search ..... 37/118 A, DIG. 19; 414/722, 685, 697, 698; 296/200, 84 E; 172/430, 701.1; 350/307

[56] References Cited

U.S. PATENT DOCUMENTS

| | | | |
|---|---|---|---|
| 3,845,870 | 11/1974 | Balderson et al. | 37/118 A |
| 3,879,059 | 4/1975 | Gibes | 296/200 X |
| 4,172,638 | 10/1979 | Freedman | 350/307 X |

FOREIGN PATENT DOCUMENTS

| | | | |
|---|---|---|---|
| 24522 | 1/1963 | German Democratic Rep. | 172/430 |
| 436009 | 12/1974 | U.S.S.R. | 414/722 |

*Primary Examiner*—Trygve M. Blix
*Assistant Examiner*—Terrance L. Siemens
*Attorney, Agent, or Firm*—Dressler, Goldsmith, Shore, Sutker & Milnamow, Ltd.

[57] ABSTRACT

A material handling element or bucket is formed from two sidewalls and a backwall. The backwall has one or more apertures postioned in such a manner that the operator manipulating the bucket can see a portion of the leading edge of the bucket. In one embodiment, the apertures are positioned in such a manner that the leading edge can be viewed directly or in combination with one or more mirrors. In another embodiment, the apertures are positioned in such a manner so that the operator can sight one or more of the sidewalls of the bucket using those sidewalls as a guide for positioning the leading edge of the bucket.

2 Claims, 5 Drawing Figures

FIG. 1
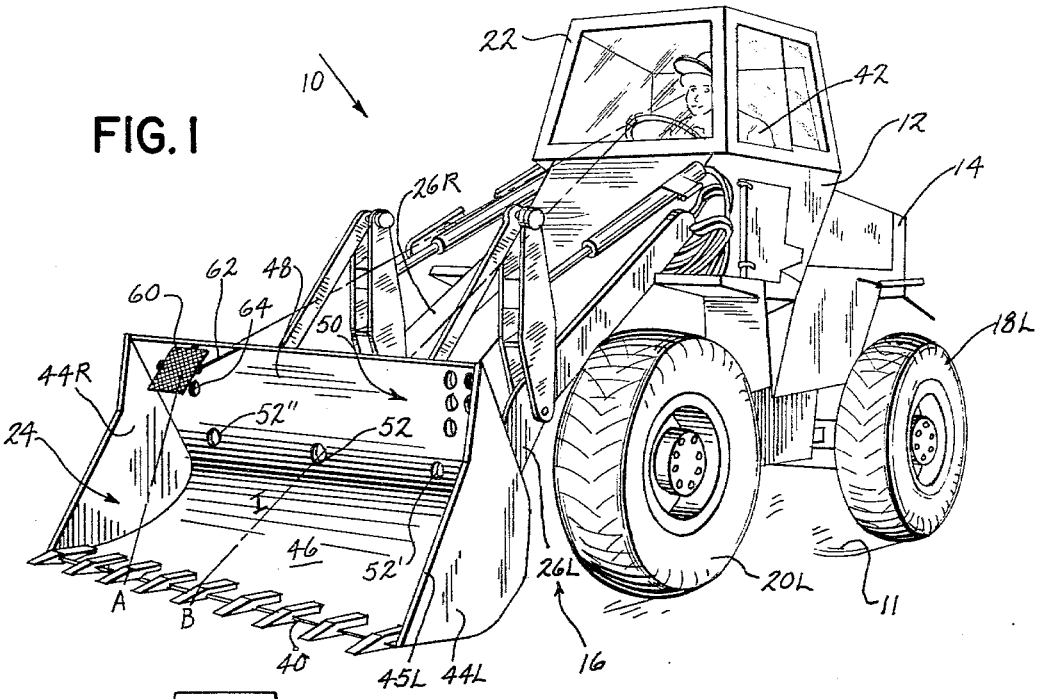
FIG. 2
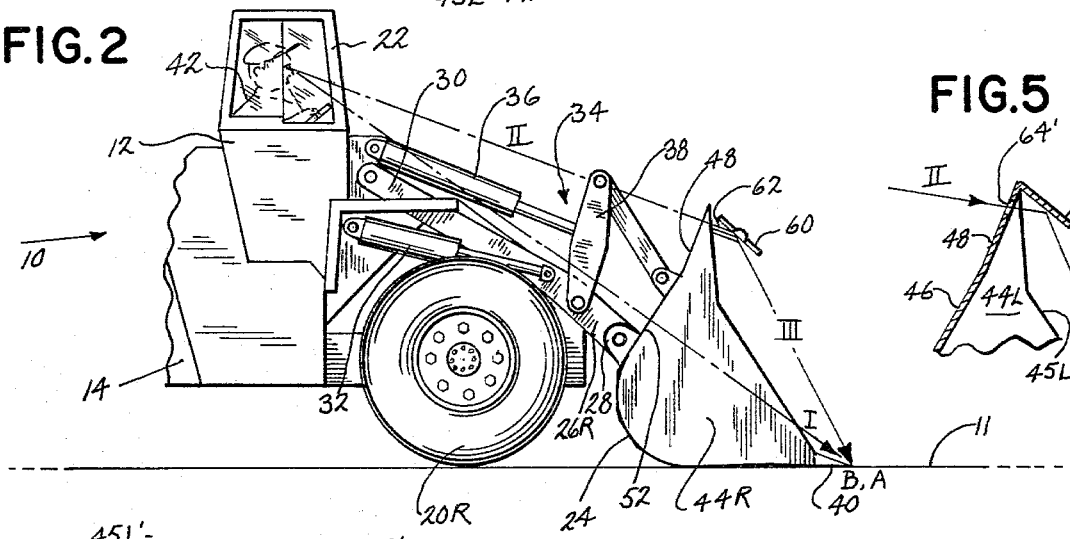
FIG. 5
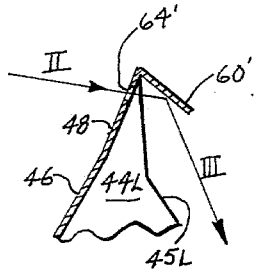
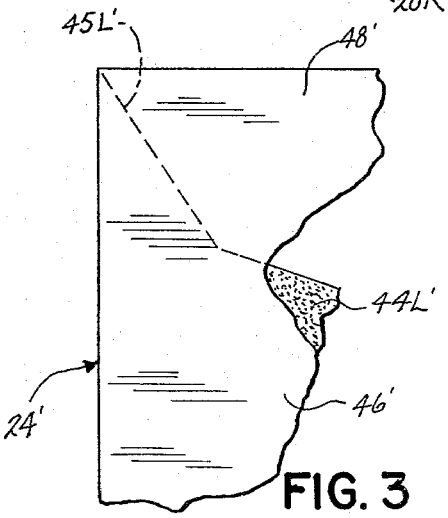
FIG. 3
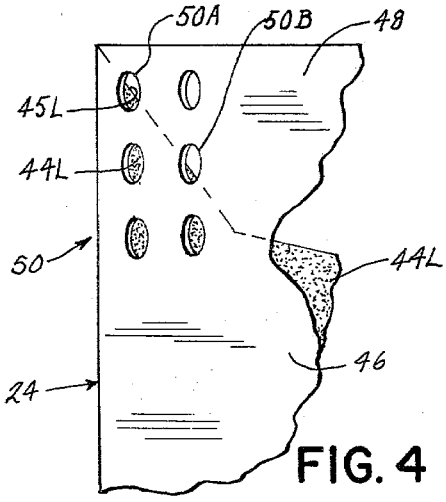
FIG. 4

SEE-THROUGH BUCKET

TECHNICAL FIELD

This invention relates to material handling equipment, and more particularly, to machines, such as loaders, having an implement such as a bucket or scoop.

BACKGROUND OF THE INVENTION

The most advanced development of the classic bulldozer is the front-end tractor shovel. This machine is also called a shovel dozer, a dozer shovel, a tractor loader, an end loader, a front loader, or just a loader. It is used for digging, loading, rough grading and limited hauling. A typical front loader includes a support frame often mounted on a tractor, a hydraulic system, a pair of push or lift arms—sometimes called a boom—hinged to the top of the support frame, a tractor-width bucket hinged to the front of the lift arms, and a pair of dump arms hinged to both of the lift arms and to the bucket. Buckets range in size from one to four and one half yards. Wheeled tractors have both smaller and larger sized buckets from five cubic feet to over twenty yards.

A standard method of digging with a tractor loader is to use low gear to force the bucket into the bank toe at ground level. When the resistance slows the tractor, the bucket is rolled back gradually and hoisted, while crowding of the tractor is continued. Rolling back the bucket as it rises in the bank increases the cutting efficiency by aligning the digging edge with its upward movement. By retracting the bucket for a thinner slice, the bucket's own suction and crowding by the tractor, tend to make the cut thicker. The proper balance among these forces varies with the machine, the bank and the position and momentum of the bucket. It is the responsibility of the machinery operator's (hereinafter also referred to as the "operator") to so balance these forces so that he will get a good bucket load in a minimum time. This requires him to have a good "feel" for the position of the leading or digging edge of the bucket.

If the machine is driven head-on into the bank and gets under too great a load the bucket may remain stuck forcing the back end of the tractor to rise. Correcting for a better angle of attack to the bank wastes time and reduces the overall efficiency of the machine. Therefore, a bucket design which improves the operator's "feel" for the position of the digging edge and his bucket will by necessity improve the overall efficiency of the machine.

Most of the medium and large size loaders supported on rubber tires are on articulated, four wheel drive tractors. The loader bucket is on the front end section or frame. The lift arms are therefore shorter than on an ordinary tractor loader and consequently rise to a steeper angle for the same bucket height. The machinery operator controlling the bucket usually sits relatively high and forward on the front frame where he has a relatively good view of the rear end of the bucket. However, by being so far forward, the operator is exposed to a greater danger of objects falling off the back of the bucket. For this reason, a "spill guard" or "spill wall" is often installed at the rear end of the bucket. This, in turn, further limits the operator's view of the interior and leading edges of the bucket when the bucket is lowered.

Large buckets and standard size buckets with large spill-guards obscure the digging edge of the bucket from view. Frequently, it is extremely difficult for the operator to manipulate his machine to properly align the digging edge with the load to be picked up. Furthermore, it is often difficult for the operator to judge the amount of payload in the bucket unless material is forced over the top of the spill guard.

Thus, a bucket design which allows the operator to directly see the leading edges or the digging edge of the bucket is particularly desirable in that the operator will not have to interpolate for the exact position of the digging edge of the bucket.

SUMMARY OF THE INVENTION

In accordance with the present invention, a material handling implement or bucket is provided incorporating a number of strategically placed apertures in the spill wall or back wall of the bucket. The apertures are aligned in such a manner that they are in the line-of-sight between the operator manipulating the bucket and the leading edge or digging edge of the bucket. One or more apertures are provided. In one embodiment, the apertures are positioned in such a manner that the operator sees that portion of the leading edge of the bucket immediately adjacent the two sidewalls or the two extreme ends of the digging edge of the bucket. Another embodiment incorporates one or more mirrors and a corresponding set of apertures enabling the operator to see selected portions of the digging edge. A bucket incorporating mirrors is especially appropriate in those loaders having an operator's cab or control station positioned asymmetrically relative to the longitudinal axis of the machine.

A bucket built with these sighting aids allows the machinery operator to more exactly position the leading edge of his bucket when digging and transferring material. This in turn improves the efficiency of the machine and improves the productivity of the machinery operator. Numerous other advantages and features of the present invention will become readily apparent from the following detailed description of the invention and the embodiments illustrated therein, from the claims, and from the accompanying drawings.

BRIEF DESCRIPTION OF THE DRAWINGS

FIG. 1 is a perspective view of a loader incorporating a bucket that is the subject of the present invention;

FIG. 2 is a partial elevational view of the loader shown in FIG. 1 illustrating the lines-of-sight maintained between the loader operator and the leading edge of the bucket;

FIG. 3 is a partial, enlarged, perspective view of the left side of the spill wall of an ordinary bucket as seen by the loader operator;

FIG. 4 is a partial, enlarged, perspective view of the left side of the spill wall of a bucket that is the subject of the present invention as seen by the loader operator; and FIG. 5 is a partial schematic diagram illustrating the line-of-sight relationship in a bucket incorporating a mirror to reflect light from the digging edge of the bucket through an aperture in the spill wall.

DETAILED DESCRIPTION

While this invention is susceptible of embodiment in many different forms, there is shown in the drawings and will herein be described in detail specific embodiments with the understanding that the present disclosure is to be considered as an exemplification of the principles of the invention and is not intended to limit the invention to the specific embodiments illustrated.

Referring to the drawings, FIG. 1 is a perspective view of an articulated loader 10 having a front section or frame 12 and a rear section or frame 14. The front and rear frames are interconnected by a coupling or joint allowing the two frames to pivot relative to one another.

The rear frame 14 is supported by a pair of rear wheels 18 (only one 18L being shown) which are attached to opposite ends of an axle joined to the rear frame 14. The rear frame 14 ordinarily incorporates a propulsion unit or engine for propelling the loader 10 and for otherwise providing a source of fluid or mechanical power.

The front frame 12 is also supported by a pair of wheels 20 (only one 20L being shown) and has an operator's cab 22 supported thereon. A material handling element or bucket 24 is pivotally supported on the forward end of the front frame 12 by a loader linkage 16. Articulation of the two frames 12, 14 relative to each other is achieved by actuating one or more fluid rams (not shown) between the two frame sections. Pivotal movement of the two frames is about a vertical axis.

The bucket 24 is disposed at the front end of the loader 10. The bucket 24 is joined to the front section 12 of the machine 10 by a pair of lift arms 26L, 26R. The particular linkage 16 used to manipulate the bucket 24 is best illustrated in FIG. 2.

FIG. 2 is a partial, side, elevational view of the articulated loader 10 shown in FIG. 1. Since each of the two lift arms 26L, 26R is identical; therefore, only one will be described in detail.

One end 28 of the lift arm 26R is pivotally connected to the bucket 24. The other end 30 of the lift arm 26R is pivotally connected to the front frame 12 of the loader 10. This lift arm 26R is raised and lowered relative to the ground or grade 11 by a hydraulic ram or actuator 32. One end of the hydraulic actuator 32 is pivotally connected to the front frame 12. The opposite end of the hydraulic actuator 32 is pivotally connected to the lift arm 26R. The bucket 24 is pivoted about the front end 28 of the lift arm 26R by a separate bucket positioning linkage 34.

The bucket positioning linkage 34 incorporates a hydraulic ram or actuator 36 and a two-piece articulated linkage 38 positioned between the bucket 24 and the hydraulic actuator 36. One end of the bucket linkage 38 is joined to the lift arm 26R. The other arm of the articulated linkage 38 is pivotally connected to the bucket 24. Thus, by extending and contracting the hydraulic actuator 36 relative to the bucket, the articulated linkage 38 manipulates the bucket between a "dumped" and "rolled back" positions.

As can be appreciated from viewing FIGS. 1 and 2 the leading edge or digging edge 40 of the bucket 24 is ordinarily out of the direct line-of-sight of the operator 42 stationed within the operator's cab 22.

As illustrated in the drawings, bucket 24 is formed from two sidewalls 44R, 44L and a bottom wall 46 interconnecting the two sidewalls to form a material-receiving channel. One (the lower one) of the two free edges of the bottom wall 46 forms the digging edge 40 of the bucket 24. The other free edge (the upper one) of the bottom wall 46, together with two sidewalls 44R and 44L, forms what is called the spill wall or spill guard 48. The spill wall 48 can be an integral part of the bottom wall 46 or a separately added plate joined to the bottom wall. As the name implies the spill wall 48 tends to prevent discharge of material from the bucket 24 when the bucket is raised above the operator's cab 22. When the spill wall 48 is juxtaposed between the digging edge 40 and the operator 22, the digging edge is ordinarily hidden from view.

Although it is often possible to manipulate the bucket 24 to raise the digging edge 40 upwardly or to otherwise "curl" the bucket so the operator 42 can see the digging edge the bucket, the digging edge would not otherwise be in or at a proper angle for digging into a pile of material. As the bucket 24 gets larger or as the spill wall 48 increases in height, it becomes more and more impossible to tilt the bucket at such an angle that the operator 42 can still see the digging edge 40 and still have the bucket aligned to pick up material.

FIG. 3 illustrates the operator'view of the upper lefthand corner of a bucket 24' having a flat unbroken spill wall 48'. If the spillwall 48 were otherwise transparent it would be possible to see at least the upper portion of the leading edge 45L' of the associated sidewall 44L.

FIG. 4 illustrates the operator's 42 view of the upper lefthand corner of a bucket 24 having a plurality of apertures 50 formed in the spill wall 48 adjacent the left hand sidewall 44L. These apertures 50 form a "window". The apertures 50 are formed by punching or cutting the bottom wall 46 or spill wall portion 48 of the bucket 24. Depending on the position of the operator 42 in relationship to the digging edge 40 of the bucket 24, the operator 42 can see front edge 45L, the adjacent side wall 44L or the digging edge 40 of the bucket 24. This is illustrated in FIGS. 1 and 2.

In FIGS. 1 and 2 the operator's 42 line-of-sight is diagramatically illustrated. The straight line labeled with a Roman Numeral I joins the digging edge 40 of the bucket 24 with the eyes of the operator 42. It will be recognized that (1) for a given horizontal distance between the digging edge 40 of the bucket 24 and the operator's cab 22 and (2) for a given size bucket 24, the higher the vertical elevation of the operator's cab on the loader 10, the better the view the apertures 50 give the operator 42 of the digging edge of the bucket. Similarly, (1) for a given vertical elevation of the operator'cab 22 above the grade 11, and (2) for a given size bucket 24, the shorter the horizontal distance between the operator's cab and the digging edge 40 of the bucket, the better the view of the operator 42 of the digging edge of the bucket.

Thus, on some loader designs by positioning the apertures 50 as shown in the drawings the operator 42 can see the digging edge 40 or at least a portion of the digging edge of the bucket 24 adjacent the sidewall 44L. If there are no other obstructions between the digging edge 40 of the bucket 24 and the operator 42, then these apertures 50 can be punched or otherwise formed in the backwall 46 so as to place the operator in direct line-of-sight (I) with the digging edge 40. This situation is shown in FIGS. 1 and 2. There an aperture 52 has been formed in the bucket 24 to place a center portion (B) the digging edge 40 in direct line-of-sight with the operator. Similarly, if additional apertures 52' and 52" are positioned closer to sidewalls 44L, 44R it is possible for the operator 42 to see the right end or left end of the digging edge 40.

It should be noted that these holes or apertures 50, wherever they may be placed in the backwall 46 of the bucket 24, are sufficiently small that very little, if any, material on the inside of the bucket will be discharged through them. Larger apertures can also be used by covering the individual apertures with screening or another mesh material. The screening would not interfere with the vision of the operator 42 but, at the same time, the mesh would minimize or reduce the amount of leakage from the inside of the bucket 24.

Of course, it is not always possible to see every possible point on the digging edge 40 regardless of the position of the apertures 50 in the backwall 46. This would be true if the body or frame structure of the loader 10 is such that it blocks the operator's 42 direct line-of-sight through the backwall 46 of the bucket 24. There are two possible solutions to this problem.

Referring to FIG. 4, for a given bucket 24 configuration and operator's cab 22 location, the perspective of the bucket 24 as viewed by the operator 42 will always form a particular angular relationship between the leading edges 45L, 45R of the sidewalls 44L, 44R and the spill wall 48 of the bucket. In other words, the operator 42 can position the apertures 50 in such a manner that, when the digging edge 40 of the bucket 24 is aligned horizontally with the grade 11, the leading edges 45L of the sidewalls 44L assume a pre-defined angular relationship. For example, the apertures 50 could be arranged so that (from the perspective of the operator 42 in the cab 22) they "appear parallel" to the leading edge 45L of the sidewall 44L. In the case shown in FIG. 4, the leading edge 45L of the associated sidewall 44L crosses one or more of the apertures 50 at a particular angle whenever the bucket 24 is aligned with the digging edge 40 parallel to the grade 11. Thus, in the case illustrated, the leading edge 45L of the sidewall 44L intercepts the aperture 50A in the first row of the left column and the aperture 50B in the second row of the right column. By painting or finishing the inside of the sidewall 44L a color distinctive from the backside of the spill wall 48, it would be easy for the operator 42 to align the digging edge 40 of the bucket 24 to any preselected angular relationship with respect to the grade 11 by using the apertures 50.

Where the apertures cannot be positioned in the backwall 46 in such a manner that the digging edge 40 of the bucket 24 is in direct line-of-sight of the operator 42, one or more mirrors can be incorporated in the bucket walls to allow the operator 42 to see the digging edge 40. FIGS. 1 and 2 illustrate this alternative.

Referring to FIG. 1 a mirror 60 has been positioned on the bucket back wall 46 in such a manner that the operator 42 can view a selected portion (A) of the digging edge 40 of the bucket 24. Specifically, an integral bracket 62 joins the mirror 60 to spill wall 48. The mirror 60 is mounted at such an angle, in relationship to the digging edge 40, that light is reflected from a portion (A) of the digging edge 40 through one or more apertures 64 in the backwall 46 directly to the eyes of the operator 42.

Depending on the specific manner in which the bucket is fabricated, the mirror 60 (instead of being joined to the backwall 46 by an integral bracket 62) can be formed as an integral extension of the spill wall 48. In other words, one of the free upper edges of the spill wall 48 can be bent in the direction of the digging edge 40 in such a manner that the line-of-sight of the operator 42 will be directed towards the digging edge of the bucket 24. This is shown diagrammically in FIGS. 1 and 2. There, the straight line path between the operator 42 and mirror 60 is identified by Roman Numeral II. The straight line path between the mirror 60 and a portion (A) of the digging edge 40 is identified by Roman Numeral III. Following the basic law of mirrors (the angle of incidence equals the angle of reflection) line II and line III will form the same angle with respect to the plane of the mirror. Thus, the operator 42 can see a selected portion of the digging edge of the bucket by viewing the mirror 60 through an aperture 64 in the spill wall 48 portion of the backwall 46. This is diagrammed in FIG. 5.

Thus it is apparent that there has been provided, in accordance with the invention, a novel material handling implement or bucket which allows the operator who manipulates the bucket to see the digging edge of that bucket thereby allowing him to efficiently position the bucket in scooping material or loading the bucket. While the invention has been described with certain specific embodiments thereof, it is evident that there are many alternatives, modifications, and variations that will be apparent to those skilled in the art in light of the foregoing description. Accordingly, it is intended to cover all such alternatives, modifications, and variations as set forth within the spirit and broad scope of the appended claims.

What is claimed is:

1. A material-handling element used with a mobile material-handling machine having an operator's control cab, comprising:

a body portion including a pair of sidewalls and wall means, interconnecting said sidewalls, for forming a material-receiving channel, said wall means defining a transversely disposed digging edge; and means joined to at least one of said sidewalls and wall means, for joining said body portion to said machine, said wall forming means being interposed between said digging edge and said control cab with said body portion in a first position relative to said machine, said wall forming means defining at least one aperture adjacent one of said sidewalls located in the line-of-sight between the operator stationed in said cab and said digging edge with said body portion in said first position, and a mirror joined to said body portion and aligned to the plane of said at least one aperture at an acute angle whereby the operator stationed in said cab and looking in the direction of said at least one aperture and mirror sees a portion of said digging edge out of the line of sight passing through said at least one aperture, whereby said operator can accurately position said body portion in said first position using said digging edge as a guide.

2. A material-handling element used with a mobile material-handling machine having an operator's control cab, comprising:

a body portion including a pair of sidewalls and wall means, interconnecting said sidewalls, for forming a material-receiving channel, said wall means defining a transversely disposed digging edge; and means, joined to at least one of said sidewalls and wall means, for joining said body portion to said machine, said wall forming means being interposed between said digging edge and said control cab with said body portion in a first position relative to said machine, said wall forming means defining at least one aperture located in the line of sight between the operator stationed in said cab and said digging edge with said body portion in said first position and being formed and polished to create an integral mirror so that light from the digging edge in the direction of the body portion is reflected through the aperture in the direction of the line of sight between the operator and the aperture and is seen by the operator, whereby said operator can accurately position said body portion in said first position using said digging edge as a guide.

* * * * *